United States Patent [19]

Svagr

[11] Patent Number: 4,953,380

[45] Date of Patent: Sep. 4, 1990

[54] DEVICE FOR GUIDING ROLLING MATERIAL IN A ROLLING MILL STAND OF A STRUCTURAL MILL

[75] Inventor: Alexander Svagr, Hilden, Fed. Rep. of Germany

[73] Assignee: SMS Schloemann-Siemag Aktiengesellschaft, Dusseldorf, Fed. Rep. of Germany

[21] Appl. No.: 373,800

[22] Filed: Jun. 29, 1989

[30] Foreign Application Priority Data

Jun. 29, 1988 [DE] Fed. Rep. of Germany ..... 3821929

[51] Int. Cl.[5] ..... B21B 39/14

[52] U.S. Cl. ..... 72/250; 72/225; 72/238

[58] Field of Search ..... 72/250, 199, 225, 234, 72/238

[56] References Cited

U.S. PATENT DOCUMENTS

| | | | |
|---|---|---|---|
| 3,583,194 | 6/1971 | Qualey | 72/238 |
| 3,691,809 | 9/1972 | Hlafcsak | 72/199 |

FOREIGN PATENT DOCUMENTS

| | | | |
|---|---|---|---|
| 58-3716 | 1/1983 | Japan | 72/250 |
| 59-19012 | 1/1984 | Japan | 72/238 |
| 63-56314 | 3/1988 | Japan | 72/250 |
| 2031771 | 4/1980 | United Kingdom | 72/250 |

*Primary Examiner*—Lowell A. Larson
*Assistant Examiner*—Thomas C. Schoeffler
*Attorney, Agent, or Firm*—Toren, McGeady & Associates

[57] ABSTRACT

In a device for the guidance of rolling material in a rolling mill stand of a shape mill, for lateral guidance of the flanges of steel sections in a flange edging stand, every lateral flange guide is constructed so as to include multiple parts, preferably three parts, and a center flange guide piece is arranged in the area of a stand window of the rolling mill stand and in the area of the roll chocks arranged in the stand window, respectively, so as to be exchangeable and/or displaceable, while the two outer flange guide elements are arranged on the stand side.

10 Claims, 4 Drawing Sheets

DEVICE FOR GUIDING ROLLING MATERIAL IN A ROLLING MILL STAND OF A STRUCTURAL MILL

BACKGROUND OF THE INVENTION

The invention is directed to a device for guiding rolling material in a rolling mill stand of a structural steel rolling mill, particularly for the lateral guidance of the flanges of steel sections, e.g. of a section beam in a flange edging stand within a reversing tandem stand group comprising a universal stand, an edging stand and a universal stand.

It is known that a so-called top pressure or bottom pressure is exerted on the rolling material during rolling, so that the rolling material is deflected downward or upward, respectively. Stripping fittings are installed behind the rolls, the rolling material running out between the stripping fittings immediately after delivery, so that the rolling material leaving the rolls is not crooked. In order to feed the rolling material to the rolls in the desired position, feed fittings are also usually provided on the input side of the rolling material at the rolling mill stand. In order to direct and guide the rolling material in a trouble-free and completely automatic manner during its movement from one rolling mill stand to the other, the advisable construction of the fittings before and after the rolls of a rolling mill stand is consequently of great importance. Disturbances in the required continuous rolling operation are more often caused by insufficiently guiding fittings than by a failure of the mechanical part of the rolling mill stand. Also, in the maintenance of the rolling mill stand or when changing the rolls, the construction of the fittings is a very substantial maintenance factor. Therefore, in the unpublished German Patent application No. P 38 05 475.2, a device has been proposed for the guidance of the rolling material between the rolls of a rolling mill stand, particularly between the horizontal work rolls of a rolling mill stand of a structural mill, in which the guide fitting is connected with the displaceably supported chock of the rolling mill stand housing receiving the rolls for the purpose of improved adaptability of the horizontal guide fitting to every rolling pass and for rapid assembly/disassembly. Such a device for guiding the rolling material has proved to be particularly advisable. It has also become known, in addition, that the lateral guidance of the rolling material, particularly of section beams in a rolling mill stand of the type mentioned above, must be improved if the rolling output of the stand and/or the changing of the rolls is to be optimized.

The present constructions, e.g. in a rolling mill stand of the generic type mentioned above, provide lateral flange guides, e.g. for section beams, which extend in one piece from the input side of the rolling mill stand until the delivery side and are cut out in sectors in the area of the roll gap of the horizontal rolls in order to adapt the side guides to the smallest rolled girder with the smallest flange width (FIG. 2/FIG. 3). As a result of the deep cut out portions in the area of the rolls, the side guides are greatly weakened and the wider flanges of large section beams are guided very poorly with the result that the flanges are formed in a saber-like manner. The wax-soft steel penetrates partially into the cut out portions of the side guides, which must compulsorily lead to the immediate interruption of the rolling process with partially considerable damage to the rolling mill stand. The elimination of such damages due to imperfect lateral guidance of the flanges is particularly time-consuming and cost-intensive, since the entire rolling mill trail is affected by it and must be turned off.

Beyond this, the known one-piece flange guides have the disadvantage that when changing rolls, the top roll, including its chocks, must be lifted over the upper edge of the side guide in order to move the rolls and chock out of the window of the rolling mill stand toward the operating side. For this purpose, a fork-like supporting construction is attached to a movable displacement platform. When changing the rolls the supporting construction is slid by means of the displacement platform between the rolls which are moved apart. The lower fork is supported on the bottom chocks and the upper fork carries the top roll including its chocks. For reasons of safety, the fork construction must be constructed so as to be particularly solid and torsion-resistant because of the loading of rolls and chocks weighing tons, which ultimately causes high costs in material and manufacturing.

SUMMARY OF THE INVENTION

Accordingly, it is an object of the present invention to improve the lateral flange guides in a flange edging stand of a shaping train of the generic type mentioned above. More particularly, it is an object to avoid the lateral breaking out of the flanges of a section beam in the area of the rolls and simultaneously to construct the side guides for the flanges in such a way that the previously known costly supporting constructions needed for changing rolls can be dispensed with.

Pursuant to this object, and others which will become apparent hereafter, one aspect of the present invention resides in every lateral flange guide being constructed so as to comprise multiple parts, preferably three parts, and the center flange guide being arranged in the area of the stand window of the rolling mill stand or in the area of the roll chocks arranged in the stand window, respectively, so as to be exchangeable and/or displaceable, while the two outer flange guide elements are arranged on the stand side. Accordingly, it is possible to optimize the lateral guidance of the flanges, e.g. of section beams, with a widely varied section program. Thus, flange widths of 100 mm to more than 500 mm can be guided safely in the edging stand, since the center flange guide pieces can be adapted to the respective flange width of a section beam to a great degree as an exchangeable constructional element. Moreover, since the height of the outer flange guide elements is dimensioned according to the maximum flange width of a section beam program, a reliable flange guidance is ensured in the input area as well as in the delivery area of the rolling mill stand. Finally, the displaceable arrangement of the center flange guide piece ensures an optimal alignment of this guide surface to the guide surfaces of the adjacent flange guide elements. The risk of lateral breaking out of the flanges of a section beam to be rolled in the area of the rolls, among others, is effectively prevented by means of the steps explained above.

In a further embodiment of the invention, the flange guide piece is constructed so as to form a spacer piece which is displaceable between the roll chocks. The flange guide pieces are thus simultaneously used as spacer pieces in order to keep the rolls at a distance when changing the rolls. These parts are moved out by the roll set when changing the rolls. The previously known costly lifting and supporting constructions on the movable displacement platform are no longer needed, since the rolls are raised only slightly from one another. The lateral flange guide thus no longer impedes the changing of the rolls.

All of this leads to a considerable economizing on machine weight and accordingly also to a considerable reduction of costs; but, above all, the changing of rolls can be carried out significantly faster. In an advisable manner, the flange guide piece is dimensioned so as to be smaller than the width of the stand window and high enough, at least in some areas, so that the rolls supporting in the chocks are kept at a distance from one another. This provides the opportunity of adapting the flange guide piece as far as possible to the width of the stand window so that enough supporting material remains on both sides of the cut out portion determined by the roll diameter to support the roll chocks.

According to another embodiment of the invention, it is provided that every flange guide piece can be locked with the top and bottom roll chocks to form an exchangeable roll set. The flange guide pieces, as roll spacer pieces, are pushed back out of the guide surface formed with the flange guide elements into the housing area until a locking with the roll chocks is effected. The constructional assembly which is accordingly produced and which comprises bottom roll with chocks, top roll with chocks and intermediately arranged spacer flange guide pieces, is movable out of the rolling mill stand as a unit and via wheel sets fastened at the chocks of the bottom roll. Thus, an extensively automated changing of rolls is made possible. Every flange guide piece is then advisably provided with at least one adjusting pin which engages in an adjusting bore hole which is correspondingly constructed and countersunk in the roll chock.

According to still another embodiment of the invention, the flange guide elements of a flange guide on the stand side are connected with adjusting devices, which are preferably hydraulically actuable, and are lockable with the respective flange guide piece to form a guide surface. Thus, if the exchange of rolls is effected with a new flange guide piece, if necessary, the roll set and the flange guide pieces are separated from one another. The flange guide pieces are subsequently displaced out of the housing area up to the guide surface formed by the flange guide elements and are securely locked in this location with the guide elements. Accordingly, a constructional unit formed from the guide elements and the guide piece is formed with a planar guide surface. This constructional unit can be adapted to the different web depths of the section beam with the aid of the hydraulic adjusting device, and securely positioned. In so doing, it is advisable that the flange guide elements on the stand side by guided approximately transversely with respect to the pitch line through the stand window of the rolling mill stand and connected with a locking beam to form a U-shaped cut out portion, and that the flange guide piece be displaceable in this cut out portion and held against a stop so as to be lockable. The guidance and fastening of the flange guide piece with the flange guide elements is improved by means of these constructional steps.

The locking beam ont he drive side of the rolling mill stand is securely connected with the flange guide elements for rapid and faultless changing of the rolls, while the locking beam on the operating side of the rolling mill stand is detachably connected with the flange guide elements and is simultaneously a fixed component part of the flange guide piece. Accordingly, it is considerably easier to move the roll set out of the rolling mill stand in the direction of the operating side.

As indicated above, the height of the flange guide elements on the stand side corresponds approximately to the full flange width of the maximum steel section to be guided in the rolling mill stand, wherein the height of the flange guide piece in the area of the rolls is approximately adapted to the respective flange width of a steel section to be guided. In this manner, the entire section assortment of a rolling program —which relates to the flange guide of the individual section rods—can be perfectly covered with few flange guide pieces which are graded relative to one another. With three to four different flange guide pieces is will be possible to guide more than a hundred steel sections in the edging stand in a faultless manner.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
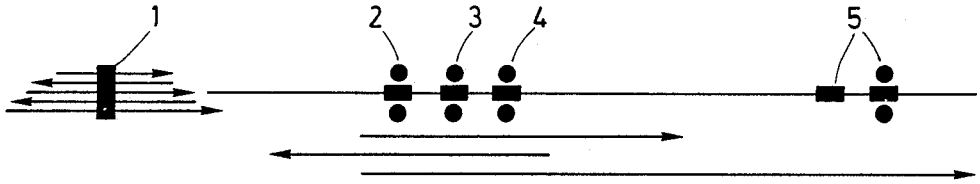
FIG. 1 shows a schematic view of a high-production rolling mill train for IPE-beams [medium flanged I-beams] and I-beams.

FIG. 1 shows a schematic view of a high-production rolling mill train for IPE-beams and I-beams with a roughing stand 1, a reversing tandem group arranged downstream and comprising a universal stand 2, a flange edging stand 3, and another universal stand 4. A finishing group 5 comprising a flange edging stand and a universal stand is arranged downstream of the reversing tandem group. The shaping passes and the edging passes are indicated by arrows according to the direction.

Figure 2:
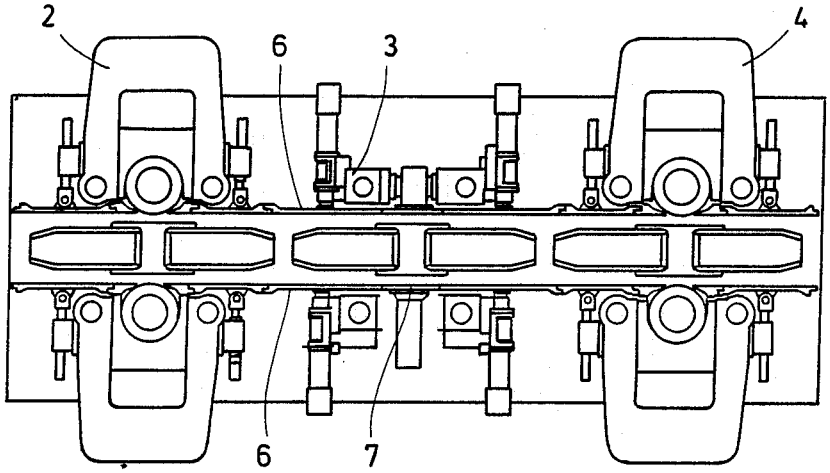
FIG. 2 shows an enlarged view of a reversing tandem group of the rolling mill train according to FIG. 1.
Figure 3:
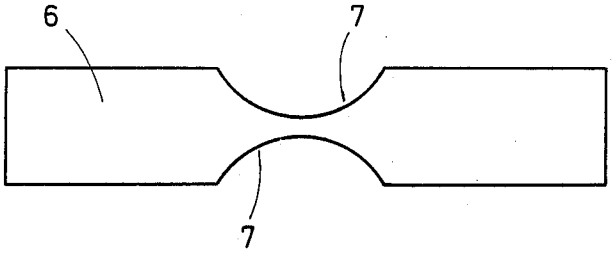
FIG. 3 shows a view of a flange side guide in a flange edging stand according to FIG. 2.

FIG. 2 shows the reversing tandem group in enlarged view in order to show the arrangement of the flange side guides, e.g. for a section beam, in the flange edging stand 3. The previously known flange side guide is shown in enlarged view again in FIG. 3. The flange side guide 6 was previously constructed in one piece and had deep cut out portions 7 in some areas in the area of the rolls, so that section beams with small flange widths of approximately 100 mm could also be rolled. The deep cut out portions 7 interrupt the flange guide in the area of the rolls so that there is a risk of damage to the flanges of the section beam and rolls in this area.

Figure 4:
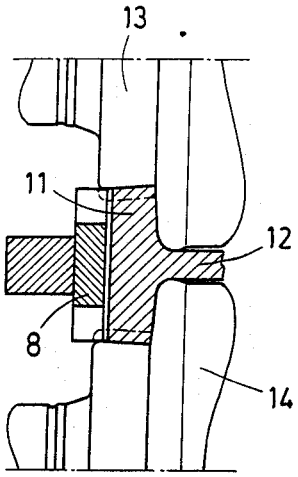
FIGS. 4 and 5 show a section and a view of the exchangeable flange guide piece, according to the invention, with flange guide elements on the stand side for larger beams and flange widths, respectively arranged adjacent to it.
Figure 5:
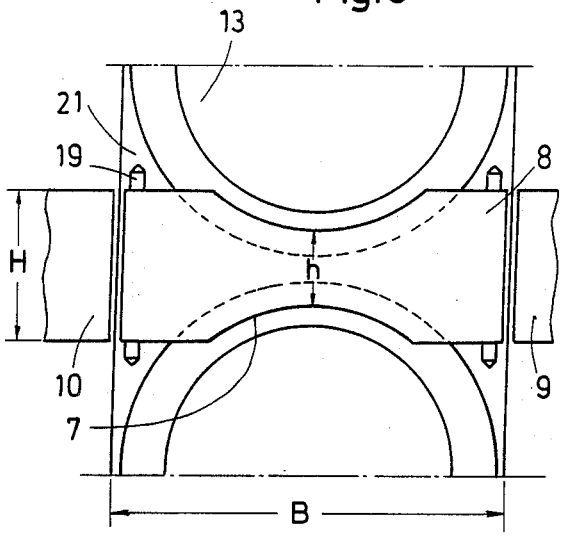
Figure 6:
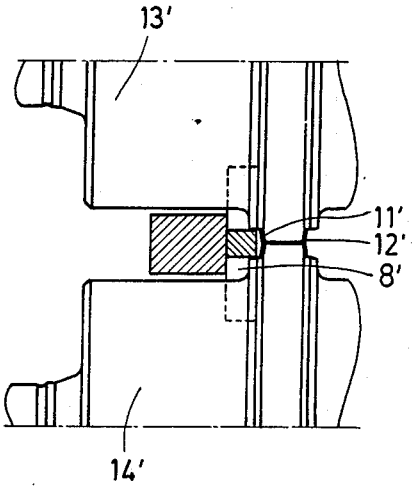
FIGS. 6 and 7 show a flange guide piece for smaller beams and flange widths which is constructed differently in comparison to FIG. 4 and FIG. 5.
Figure 7:
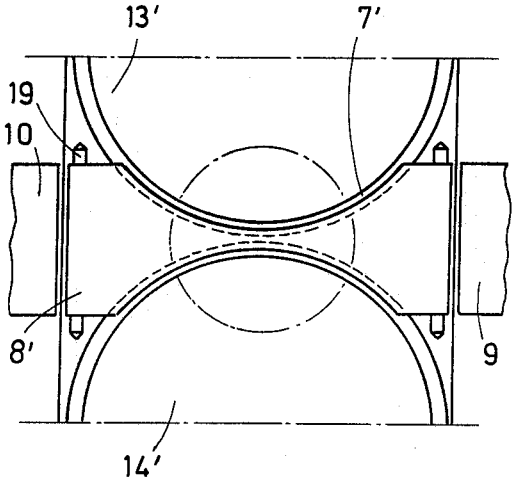

FIGS. 4 and 5 show the new development, according to the invention, in which every lateral flange guide 6 is constructed so as to comprise multiple parts—three parts in the present case—and so as to comprise a central flange guide piece 8 and two lateral flange guide elements 9, 10 arranged adjacent to it. According to FIG. 4, a relatively wide flange 11 of a T-section beam 12 is upset by the horizontal rolls 13, 14. FIGS. 6 and 7 show the rolling of a T-beam 12' with a small flange 11' between the rolls 13' and 14', which T-beam 12' has a markedly small section. It can be clearly seen, according to FIG. 5, that the cut out portion 7 in the flange guide piece 8, which cut out portion 7 is determined by the rolls 13, 14, is shaped substantially differently than the cut out portion 7' in the flange guide piece 8' according to FIG. 7. While the height H of the flange guide elements 9, 10 on the stand side corresponds approximately to the full flange width of the maximum section beam to be guided in the rolling mill stand, the height h of the flange guide piece 8, 8' in the area of the rolls is adapted approximately to the respective flange width of a steel section to be guided. The exchanging of the flange guide pieces 8, 8' is normally effected together with the exchanging of the rolls. A comparison of the flange guide pieces 8, 8' in FIG. 5 and FIG. 7, moreover, clearly shows that an optimal flange guidance is enabled by means of the flange guide pieces which are graded with respect to the rolling program.

Figure 8:
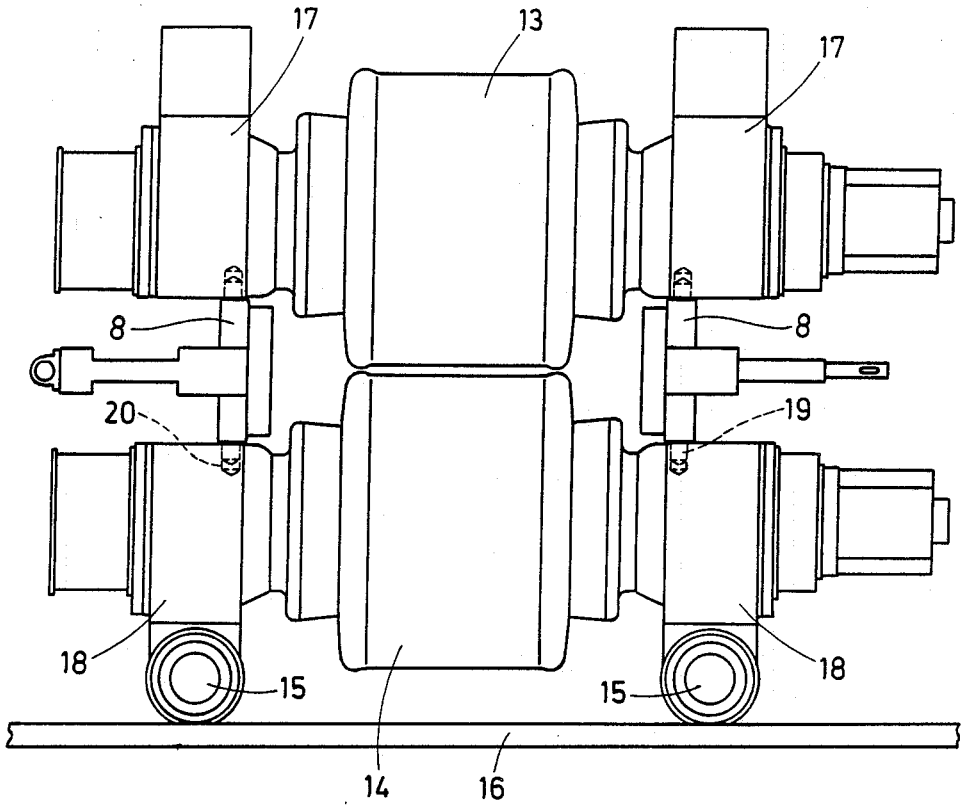
FIG. 8 shows a schematic view of a flanged guide piece used as a roll spacer piece.

FIG. 8 shows that the flange guide pieces 8 are constructed to form spacer pieces which are displaceable between roll chocks 18. Together with the flange guide pieces 8, the rolls 13 and 14 form a roll set which is movable out of the stand on rails 16 by means of a pair of wheels 15. The flange guide pieces 8 are arranged between the roll chocks 17 of the top roll 13 and the roll chocks 18 of the bottom roll 14 and keep the disassembled rolls apart. Every flange guide piece is provided with an adjusting pin 19 which engages in an adjusting bore hole 20 which is correspondingly constructed and countersunk in the roll chocks 17, 18. Every flange guide piece 8 is preferably constructed so as to be smaller than the width B of a stand window 21 and, at least in areas lying furthest from the roll axis, is dimensioned so as to be high enough that the rolls 13, 14 supported in the chocks 17, 18 are at a distance from one another. In this way, the roll set shown in FIG. 8 can be moved out of the rolling mill stand 3 as a complete unit for the purpose of changing the rolls.

Figure 9:
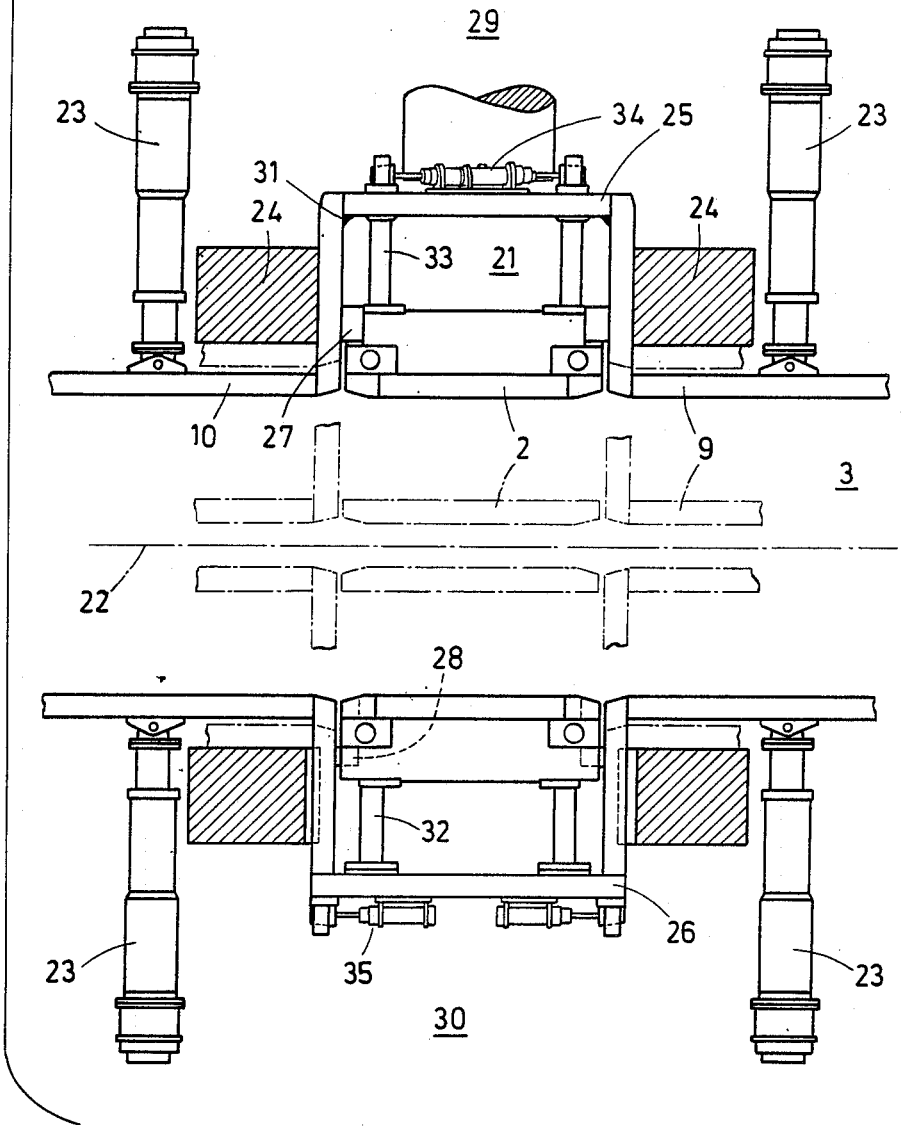
FIG. 9 shows a view of the flange guide piece which is lockable and displaceable with the flange guide elements.

The flange guide elements 9, 10 of a flange guide on the stand side are connected with hydraulically actuable adjusting devices 23 as shown in FIG. 9, and are locked with the respective flange guide piece 8 to form a guide surface. The flange guide piece 8 and the flange guide elements 9, 10 can be displaced into the position shown with dashed lines by the adjusting devices 23. The flange guide elements 9, 10 on the stand side are guided through the stand window 21 of the stand housing 24 of the rolling mill stand 3 approximately transversely relative to the pitch line 22 and are connected with a locking beam 25 to form a U-shaped cut out portion, wherein the flange guide piece 8 is displaceable in this cut out portion and is held against an adjusting stop 27, 28 so as to be lockable. The locking beam 25 on the drive side 29 of the rolling mill stand 3 is securely connected with the flange guide elements 9, 10, e.g. by means of a weld connection 31. A locking beam 26 on the operating side 30 of the rolling mill stand 3 is detachably connected with the flange guide elements 9, 10. The locking beam 26 is simultaneously a fixed component part of the flange guide piece 8 via the connecting pin 32. The flange guide pieces 8 have the adjusting pin 19 on their upper side.

For the purpose of changing the rolls, the flange guide pieces 8 are moved back into the area of the roll chocks 17, 18 by means of the adjusting devices 23 until the adjusting pins 19 of the flange guide pieces 8 are opposite the adjusting bore holes 20 in the roll chocks and engage in the latter, so that the rolls 13, 14 are locked with their chocks 17, 18 to form a roll set. The flange guide pieces 8 are then unlocked on the stand side in that a hydraulic lock 34, e.g. a piston-cylinder unit, releases the connecting pin 33 on the drive side and the latter can be pulled through the bore holes arranged in the locking beam 25. On the operating side 30 of the rolling mill stand 3, the unlocking of the flange guide piece 8 on the stand side is effected in that the hydraulic lock 35, e.g. a piston-cylinder unit, releases the locking beam 26 of the flange guide piece 8. The flange guide pieces 8 now act as spacer pieces for the roll set. The entire roll set can then be moved out of the stand 3 through the stand window 21 by means of the wheel pair 15 running on the rails 16. The disassembly and installation of the rolls, the exchange of rolls, and the exchange of and adapting of the flange guide pieces/-spacer pieces to the section program can be effected much more quickly than before and automated to a great extent. In addition, the different steel sections can be guided laterally in the rolling mill stand with great reliability.

While the invention has been illustrated and described as embodied in a device for guiding rolling material in a rolling mill stand of a structural mill, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims.

1. A device for guiding rolling stock in a flange edging roll stand of a shape steel rolling mill, the roll stand being within a reversing tandem group including a first universal stand, an edging stand and a second universal stand, the device comprising lateral flange guides 6 constructed of three parts including a center flange guide piece arranged in an area of a stand window 21 of the roll stand 3 or in an area of roll chocks 17, 18 arranged in the stand window 21, respectively, so as to be exchangeable and displaceable, and two outer flange guide elements 9, 10 arranged on a side of the stand, and further comprising hydraulically actuable adjusting means 23 connected with the outer flange guide elements 9, 10 of a flange guide on the stand side, the outer flange guide elements 9, 10 being lockable with a respective flange guide piece 8 so as to form a guide surface.

2. A device according to claim 1, wherein the flange guide piece 8 is provided as a spacer piece displaceable between the roll chocks 17, 18.

3. A device according to claim 1, wherein the flange guide piece 8 is smaller than a width B of the stand window 21 and is at least partially dimensioned with respect to height so that rolls 13, 14 supported in the roll chocks 17, 18 are kept at a distance.

4. A device according to claim 1, wherein the flange guide piece 8 is lockable with the roll chocks 17, 18 so as to form an exchangeable roll set.

5. A device according to claim 1, wherein the flange guide piece 8 is provided with at least one adjusting pin 19 arranged so as to engage in a corresponding adjusting bore hole 20 countersunk in the roll chocks 17, 18.

6. A device according to claim 1, wherein the flange guide elements 9, 10 on the stand have a height H which corresponds approximately to a full flange width of a maximum steel section to be guided in the roll stand 3, the flange guide piece 8 having a height h adapted in the roll area approximately to a respective flange width of a steel section to be guided.

7. A device according to claim 1, wherein the flange guide elements 9, 10 on the stand side are guidable through the stand window 21 of the roll stand 3 approximately transversely relative to a pitch line 22 and are connected with a locking beam 25, 26 so as to form a U-shaped cut out portion, the flange guide piece 8 being displaceable in this cut out portion and held against a stop 27, 28 so as to be lockable.

8. A device according to claim 7, wherein the locking beam 25 is securely connected on a drive side 29 of the roll stand 3 with the flange guide elements 9, 10.

9. A device according to claim 7, wherein the locking beam 26 on an operating side 30 of the roll stand 3 is detachably connected with the flange guide elements 9, 10 and is simultaneously a fixed component part of the flange guide piece 8.

10. A device according to claim 1, wherein the rolling material is one of flanged steel sections and section beams.

* * * * *